US010646010B2

(12) United States Patent
Rutgerson

(10) Patent No.: US 10,646,010 B2
(45) Date of Patent: May 12, 2020

(54) METHODS AND APPARATUSES FOR SETTING JEWELRY

(71) Applicant: Jon Rutgerson, Rhinebeck, NY (US)

(72) Inventor: Jon Rutgerson, Rhinebeck, NY (US)

( * ) Notice: Subject to any disclaimer, the term of this patent is extended or adjusted under 35 U.S.C. 154(b) by 0 days.

(21) Appl. No.: 15/994,430

(22) Filed: May 31, 2018

(65) Prior Publication Data

US 2019/0008244 A1 Jan. 10, 2019

Related U.S. Application Data

(60) Provisional application No. 62/513,258, filed on May 31, 2017.

(51) Int. Cl.
*A44C 17/02* (2006.01)
*A44C 17/04* (2006.01)

(52) U.S. Cl.
CPC ..... *A44C 17/02* (2013.01); *A44C 17/04* (2013.01)

(58) Field of Classification Search
CPC ..... A44C 17/02; A44C 17/04
USPC ..... 63/26–28; D11/90–91
See application file for complete search history.

(56) References Cited

U.S. PATENT DOCUMENTS 7,707,722 B1 * 5/2010 Kothari ..... A44C 17/04 29/10
2016/0021993 A1 * 1/2016 Nevatia ..... A44C 17/02 63/28

* cited by examiner

*Primary Examiner* — Jack W Lavinder
(74) *Attorney, Agent, or Firm* — Tarter Krinsky & Drogin LLP

(57) ABSTRACT

Exemplary embodiments of methods and apparatuses for setting stones into jewelry models of various shapes are provided. In some exemplary embodiments, a combination of one or more small stones and one or more large stones can be provided in models having various shapes, such as but not limited to a marquise or pear shaped model. For example, an article can be provided including a model having an inner wall, an upper portion and a lower portion, an upper stone seating provided at the upper portion and a lower stone seating provided at the lower portion of the model, a middle stone seating between the upper stone seating and lower stone seating, and a plurality of prongs between the upper stone seating and lower stone seating placed along the inner wall around a periphery of the middle stone seating, wherein each of the plurality of prongs have a lower portion and an upper portion, where the lower portion is thicker than the upper portion of the prongs.

16 Claims, 24 Drawing Sheets

METHODS AND APPARATUSES FOR SETTING JEWELRY

CROSS-REFERENCE TO RELATED APPLICATIONS

This application relates to and claims priority from U.S. Provisional Patent Application Ser. No. 62/513,258 filed May 31, 2017, the entire disclosure of which is hereby incorporated herein by reference.

FIELD OF THE DISCLOSURE

The present disclosure relates to exemplary embodiments of methods and apparatuses for setting stones, and more particularly, to exemplary embodiments of methods and apparatuses for setting stones in models of various shapes.

BACKGROUND INFORMATION

Precious stones are often set at the top of a model with a combination of smaller stones and one or more larger stones using conventional prong type settings. In addition, pave setting techniques can also be employed to provide greater glitter for the jewelry. However, multiple prongs are often used to set each stone which can make the model visually less appealing.

SUMMARY OF EXEMPLARY EMBODIMENTS OF THE DISCLOSURE

At least some of the above described problems can be addressed by exemplary embodiments of the present disclosure. Exemplary embodiments of the present disclosure can provide for methods and apparatuses for setting stones into jewelry models of various shapes.

In some exemplary embodiments, an article can be provided comprising a model having an inner wall, an upper portion and a lower portion, an upper stone seating provided at the upper portion and a lower stone seating provided at the lower portion of the model, a middle stone seating between the upper stone seating and lower stone seating, and a plurality of prongs between the upper stone seating and lower stone seating placed along the inner wall around a periphery of the middle stone seating, wherein each of the plurality of prongs have a lower portion and an upper portion, where the lower portion is thicker than the upper portion of the prongs.

In some exemplary embodiments, at least two of the plurality of prongs are upper prongs provided between the upper stone seating and the middle stone seating. In some exemplary embodiments, at least two of the plurality of prongs are lower prongs provided between the lower stone seating and the middle stone seating. The lower portion of the upper prongs can be configured to secure a stone in the upper stone seating, and the lower portion of the lower prongs can be configured to secure a stone in the lower stone seating. The upper portion of the upper prongs and the upper portion of the lower prongs can be configured to secure a stone in the middle stone seating.

In some exemplary embodiments, the article further comprises a top prong placed between the inner wall and the upper stone seating for securing a stone in the upper stone seating, and a bottom prong placed between the inner wall and the lower stone seating for securing a stone in the lower stone seating. The article can further comprise a top stone placed in the upper stone seating, a bottom stone placed in the lower stone seating, and a middle stone placed in the middle stone seating, the middle stone being larger than the top and bottom stones and when secured within the marquise shaped model, having a top surface with a greater height than a top surface of the top and bottom stones.

In some exemplary embodiments, the article can further comprise an outer upper portion above the inner wall and surrounding the upper stone seating, the lower stone seating and middle stone seating, wherein the outer upper portion is configured to be hammered down to provide a bezel for securing the top stone, bottom stone and middle stone. In some exemplary embodiments, the model can be a marquise shaped model.

In some exemplary embodiments, an article can be provided comprising a model having an inner wall, an upper portion and a lower portion, an upper stone seating provided at the upper portion of the marquise shaped model, a lower stone seating provided at the lower portion of the marquise shaped model, and a first prong and a second prong between the upper stone seating and lower stone seating placed along the inner wall, wherein the first and second prongs have a lower portion and an upper portion, where the lower portion is thicker than the upper portion of the first and second prongs.

In some exemplary embodiments, the lower portion of the first and second prongs can be configured to secure a stone in the upper stone seating. In some exemplary embodiments, the upper portion of the first and second prongs can be configured to secure a stone in the lower stone seating.

In some exemplary embodiments, the article can further comprise a third prong placed between the inner wall and the upper stone seating for securing a stone in the upper stone seating. In some exemplary embodiments, the article can further comprise a top stone placed in the upper stone seating, and a bottom stone placed in the lower stone seating, wherein the bottom stone is larger than the top stone and when secured within the model, having a top surface with a greater height than a top surface of the top stone.

In some exemplary embodiments, the article can further comprise an outer upper portion above the inner wall and surrounding the upper stone seating and the lower stone seating, wherein the outer upper portion is configured to be hammered down to provide a bezel for securing the top stone and bottom stone. In some exemplary embodiments, the model can be a pear shaped model.

BRIEF DESCRIPTION OF THE DRAWINGS

The foregoing and other objects of the present disclosure will be apparent upon consideration of the following detailed description, taken in conjunction with the accompanying drawings and claims, in which like reference characters refer to like parts throughout, and in which:

FIG. 1(*b*) illustrates a top view of a pear shaped model according to an exemplary embodiment of the present disclosure;

FIG. 14(*b*) illustrates a perspective view of a pear shaped model with stones according to an exemplary embodiment of the present disclosure;

Figure 1B:
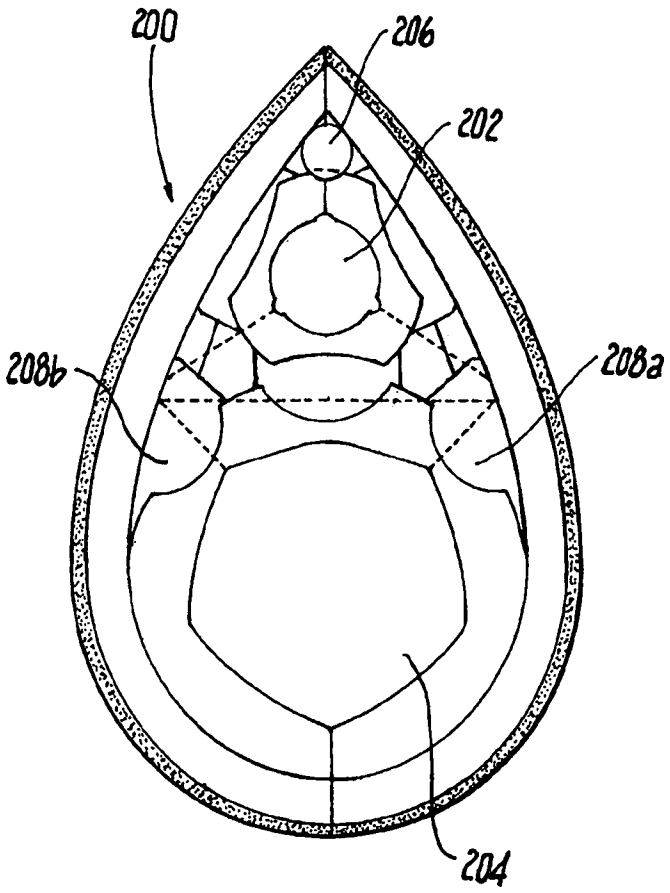
FIG. 1(*a*) illustrates a top view of a marquise shaped model according to an exemplary embodiment of the present disclosure.

Throughout the figures, the same reference numerals and characters, unless otherwise stated, are used to denote like features, elements, components or portions of the illustrated embodiments. Moreover, while the subject disclosure will now be described in detail with reference to the figures, it is done so in connection with the illustrative embodiments. It is intended that changes and modifications can be made to the described embodiments without departing from the true scope and spirit of the subject disclosure.

DETAILED DESCRIPTION OF EXEMPLARY EMBODIMENTS OF DISCLOSURE

The exemplary embodiments of the present disclosure can provide for methods and apparatuses for setting stones into jewelry models of various shapes. In some exemplary embodiments, a combination of one or more small stones and one or more large stones can be provided in models having various shapes, such as but not limited to a marquise or pear shaped model. The stones can be jewels of various types, shapes and patterns, and can be round in some exemplary embodiments.

Exemplary embodiments of the various methods and apparatuses will now be described with reference to the figures. The following description of the various embodiments is merely exemplary in nature and is in no way intended to limit the scope of the disclosure, its application, or uses.

Figure 1A:
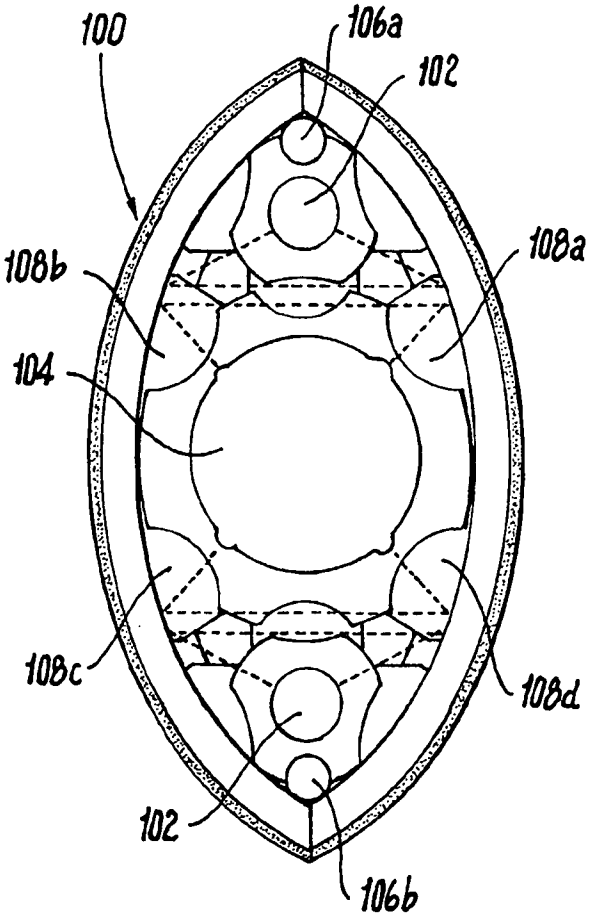
Figure 2:
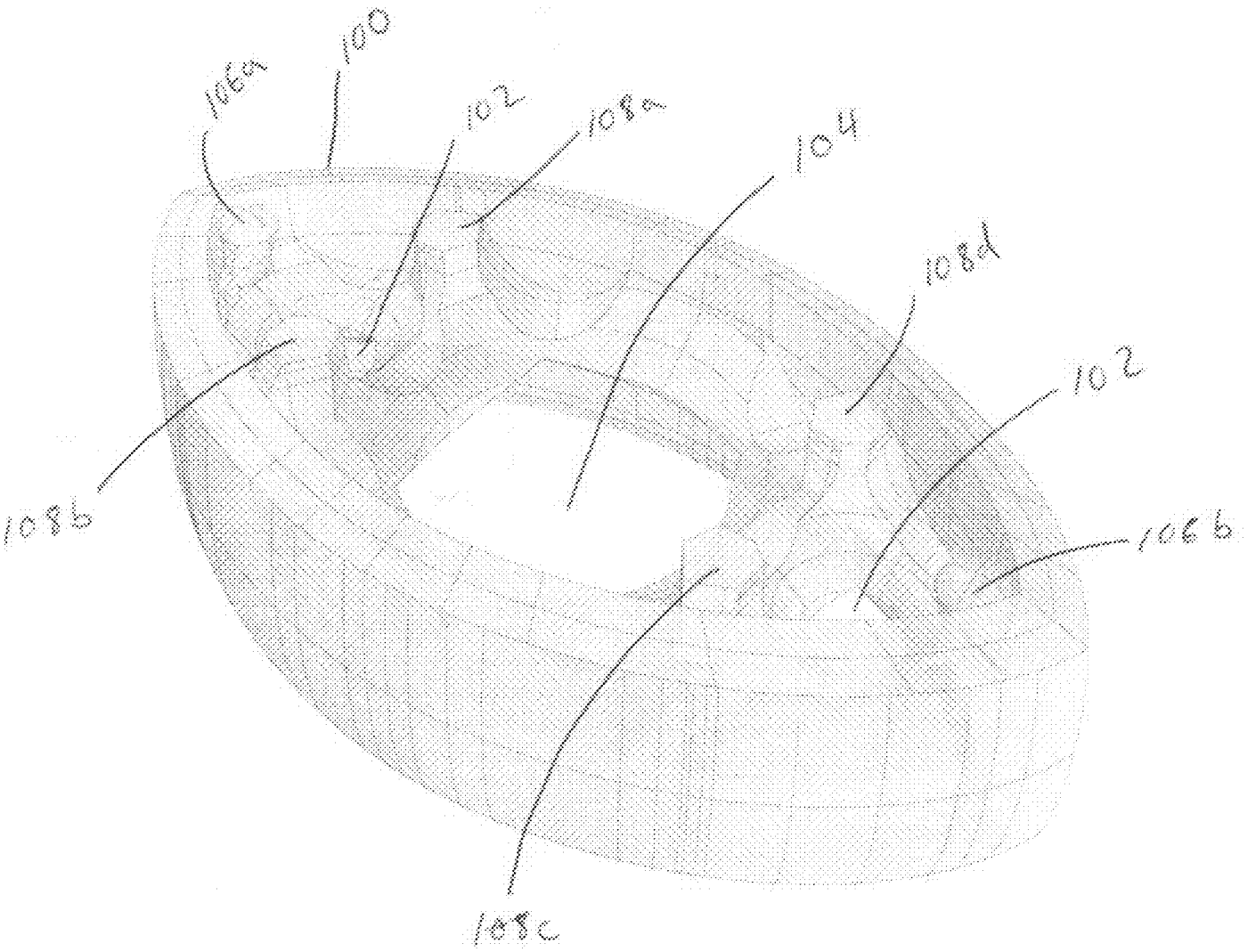
FIG. 2 illustrates a perspective view of a marquise shaped model according to an exemplary embodiment of the present disclosure.

FIG. 1(*a*) illustrates a top view of a marquise shaped model 100 according to an exemplary embodiment of the present disclosure, and FIG. 2 illustrates a perspective view of a marquise shaped model 100 according to an exemplary embodiment of the present disclosure. The marquise shaped model 100 can have small stone seats 102, and a large stone seat 104. The stone seats can comprise a hole and a portion of the lower wall that holds the stone. End prongs 106*a* and 106*b* can be provided, and inner prongs 108*a*, 108*b*, 108*c* and 108*d* can be provided within the marquise shaped model 100. As shown, inner prongs 108*a*, 108*b*, 108*c* and 108*d* can have a structure that is thicker at a lower portion of the inner prongs 108*a*, 108*b*, 108*c* and 108*d*.

Figure 3:
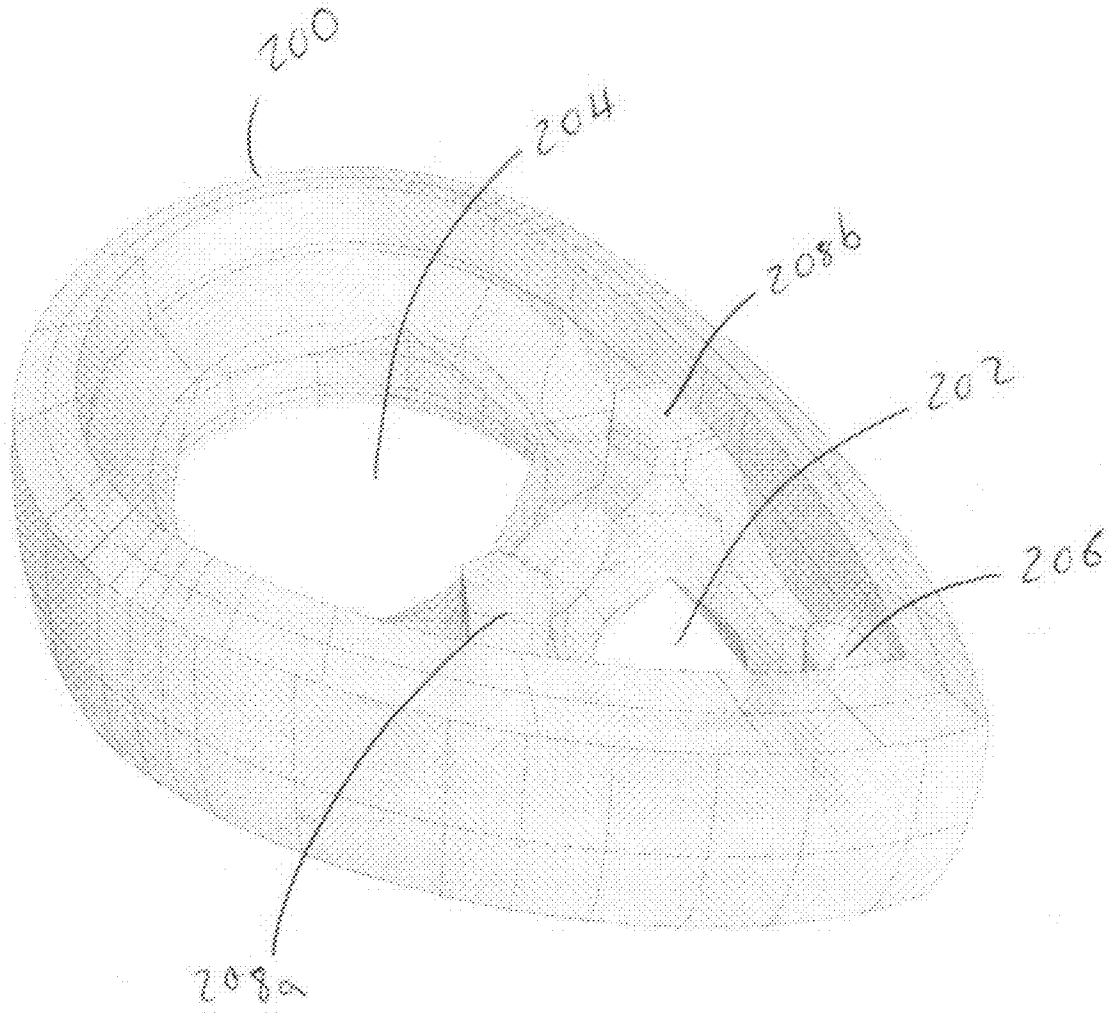
FIG. 3 illustrates a perspective view of a pear shaped model according to an exemplary embodiment of the present disclosure.

FIG. 1(*b*) illustrates a top view of a pear shaped model 200 according to an exemplary embodiment of the present disclosure, and FIG. 3 illustrates a perspective view of a pear shaped model 200 according to an exemplary embodiment of the present disclosure. The pear shaped model 200 can have a small stone seat 202 and a large stone seat 204. End prong 206 can be provided, and inner prongs 208*a* and 208*b* can be provided within the pear shaped model 100. As shown, inner prongs 208*a* and 208*b* can have a structure that is thicker at a lower portion of the inner prongs 208*a* and 208*b*.

Figure 4:
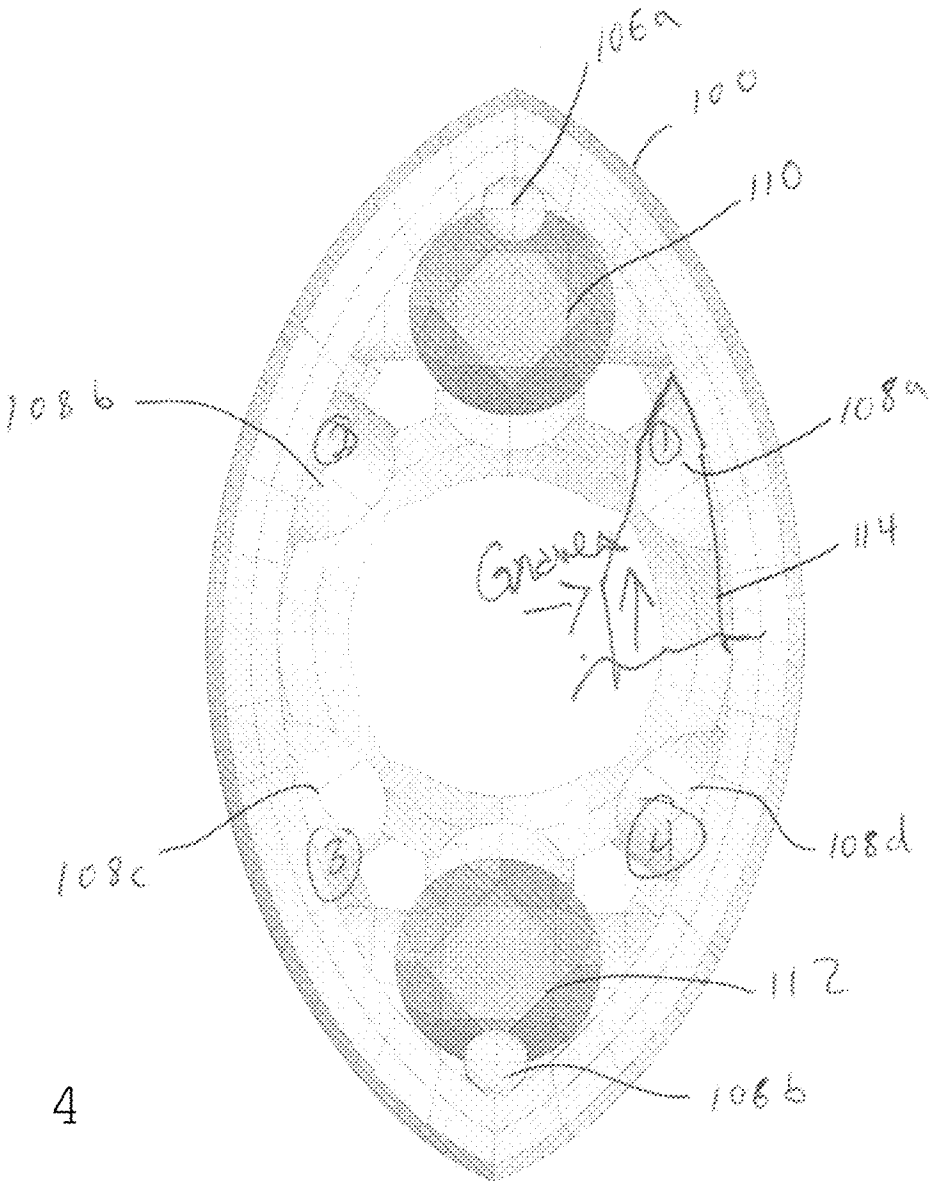
FIG. 4 illustrates a top view of a marquise shaped model with stones according to an exemplary embodiment of the present disclosure.

As shown in FIG. 4, the stone seats 102 and 104 can be cleaned up with a bur for the marquise shaped model 100. Small stone 110 can then be inserted at an angle under end prong 106*a* and small stone 112 can be inserted at an angle under end prong 106*b*. The small stones 110 and 112 can be rotated to fit under the end prongs. A graver 114, such as a flat graver, or a splitter, or any tool that can pry the prong from the wall, can be used to push the inner prongs 108*a* and 108*b* at a lower thicker portion of the prongs toward the small stone 110 and away from the wall of the model 100 to disrupt the inner prongs 108*a* and 108*b* to secure the small stone 110. A flat graver can then be used to push the inner prongs 108*c* and 108*d* toward the small stone 112 and away from the wall of the model 100 to disrupt the inner prongs 108*c* and 108*d* to secure the small stone 112.

Figure 5:
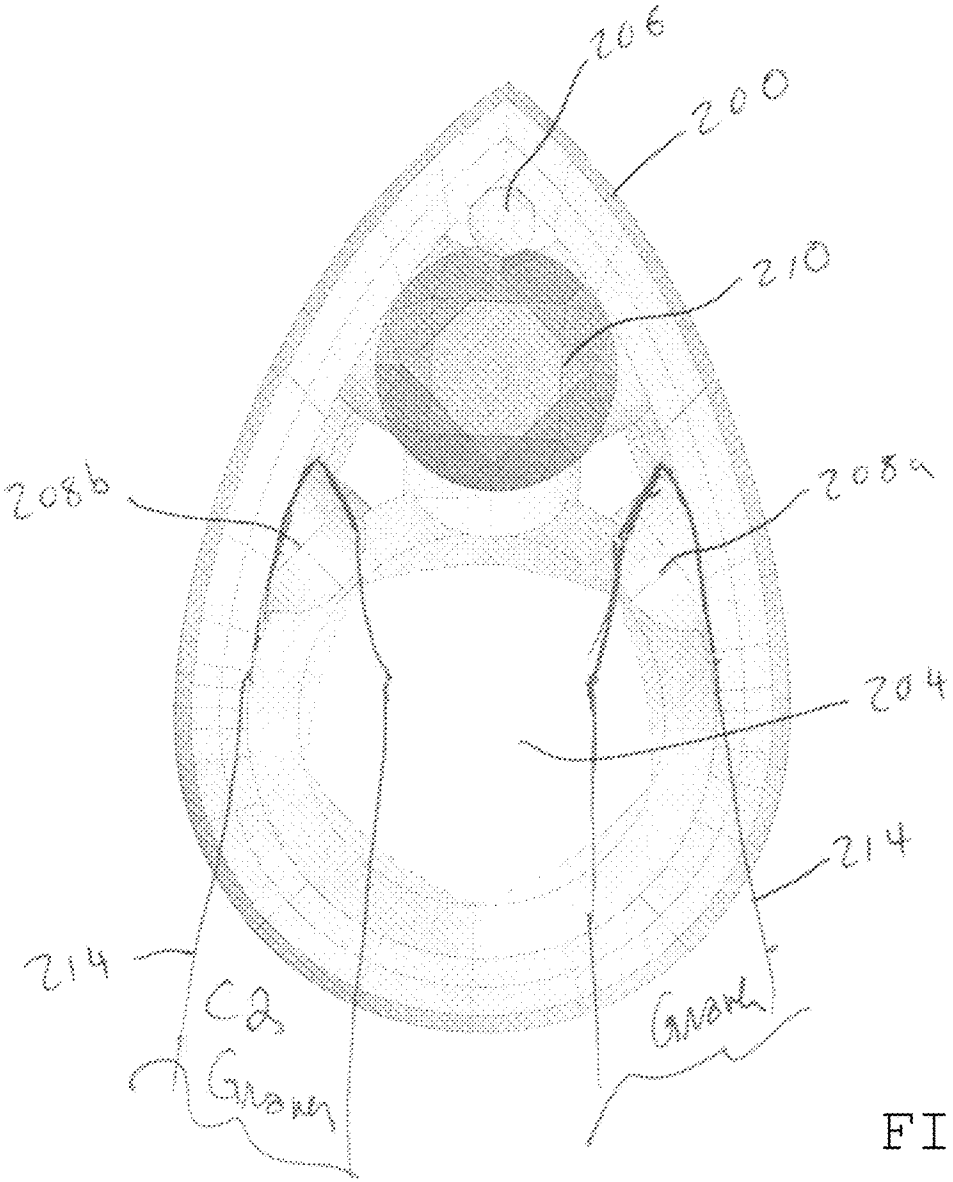
FIG. 5 illustrates a top view of a pear shaped model with a stone according to an exemplary embodiment of the present disclosure.

Similarly, as shown in FIG. 5, the stone seats 202 and 204 can be cleaned up with a bur for the pear shaped model 200. Small stone 210 can then be inserted at an angle under end prong 206 and rotated to fit under the end prong 206. A graver 214, such as a flat graver, can be used to push the lower thicker portion of the inner prongs 208*a* and 208*b* toward the small stone 210 and away from the wall of the model 200 to disrupt the inner prongs 208*a* and 208*b* to secure the small stone 210.

Figure 6B:
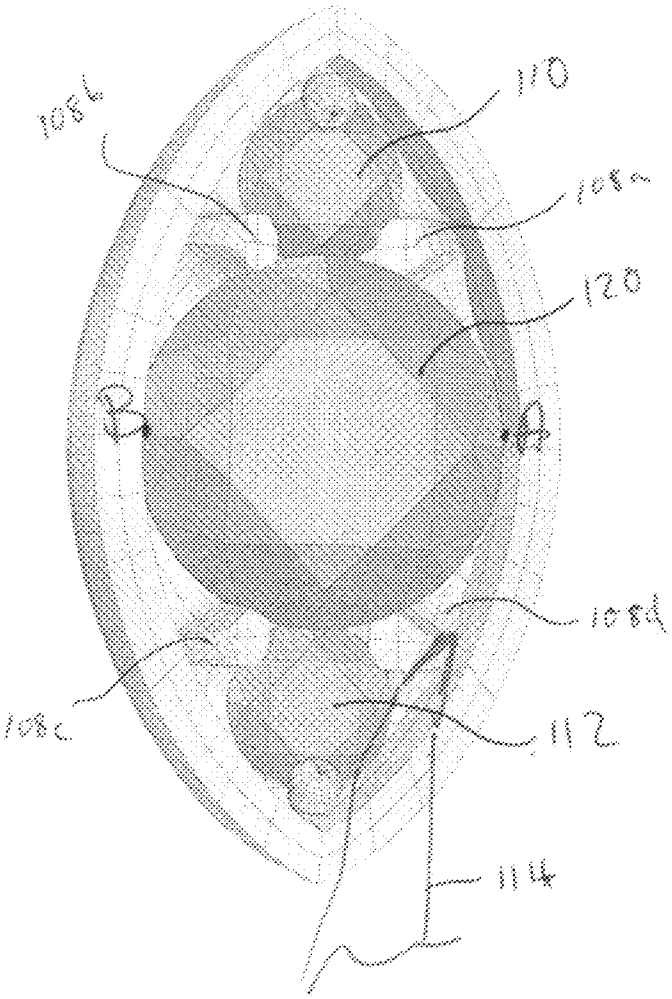
FIGS. 6(*a*) and 6(*b*) illustrate a top view of a marquise shaped model with stones according to an exemplary embodiment of the present disclosure.
Figure 6A:
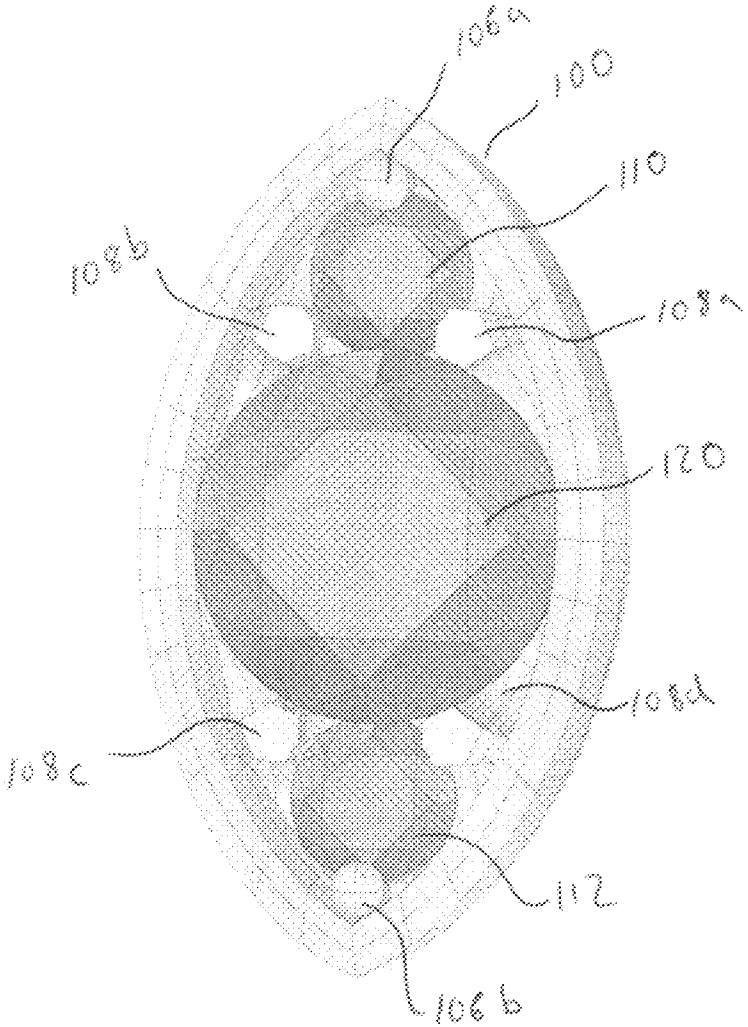

As shown in FIG. 6(*a*), a large stone 120 can then be inserted into the large stone seat 104. As shown in FIG. 6(*b*), the large stone 120 can be inserted and rotated into position from A to B or B to A. A graver 114 can be used to move an upper thinner portion of the prongs 108*a*, 108*b*, 108*c* and 108*d* away from the wall of the model 100, securing the large stone 120 within the marquise shaped model 100. In some exemplary embodiments, the diameter of the large stone 120 can be slightly larger than a width of a center portion of the marquise shaped model 100, allowing a snug fit and further securing the large stone 120 in the marquise shaped model 100.

Figure 7B:
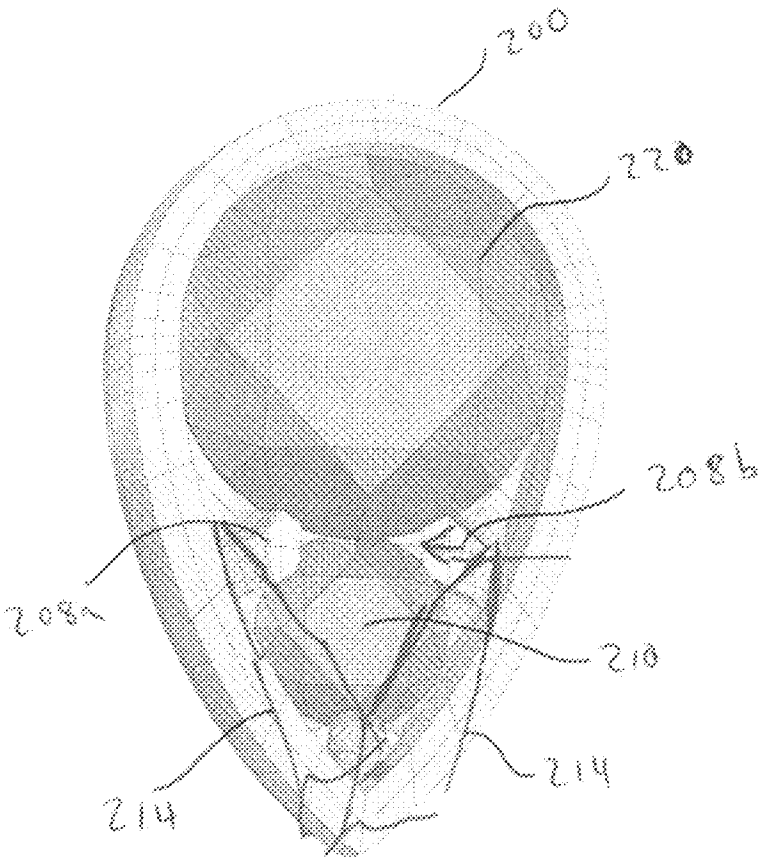
FIGS. 7(*a*) and 7(*b*) illustrate a top view of a pear shaped model with stones according to an exemplary embodiment of the present disclosure.
Figure 7A:
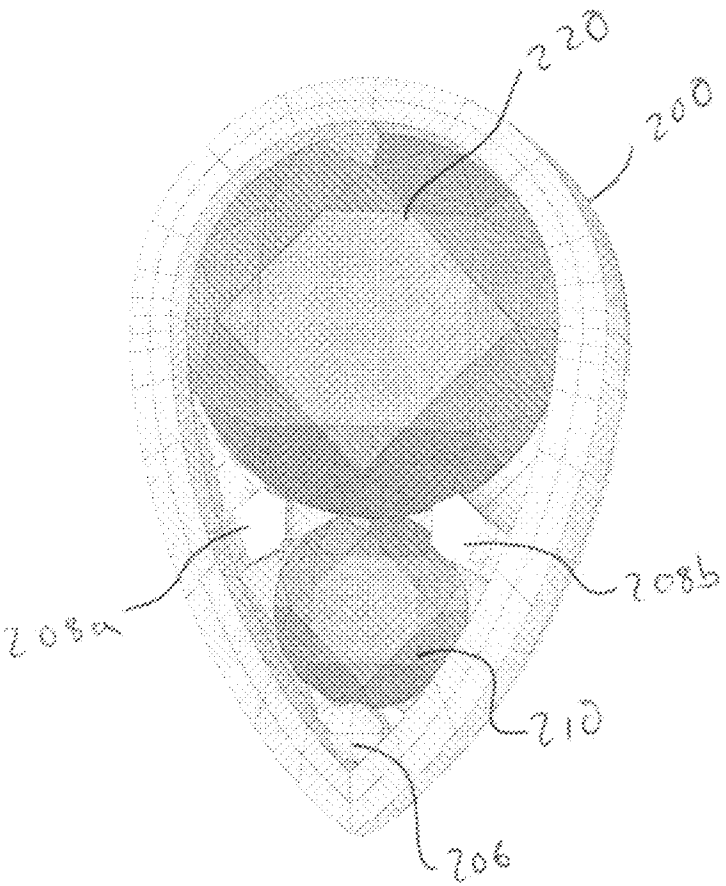

As shown in FIG. 7(*a*), for the pear shaped model 200, a large stone 220 can then be inserted into the large stone seat 204. The large stone 220 can be inserted at an angle toward a rounded end of the pear shaped model 200 and rotated to be placed within the pear shaped model 200. As shown in FIG. 7(*b*), a graver 214 can be used to move an upper thinner portion of the prongs 208*a* and 208*b* away from the wall of the model 200, securing the large stone 220 within the pear shaped model 200. In some exemplary embodiments, the diameter of the large stone 220 can be slightly larger than a width of a center portion of the pear shaped model 200, allowing a snug fit and further securing the large stone 220 in the pear shaped model 200.

Figure 8:
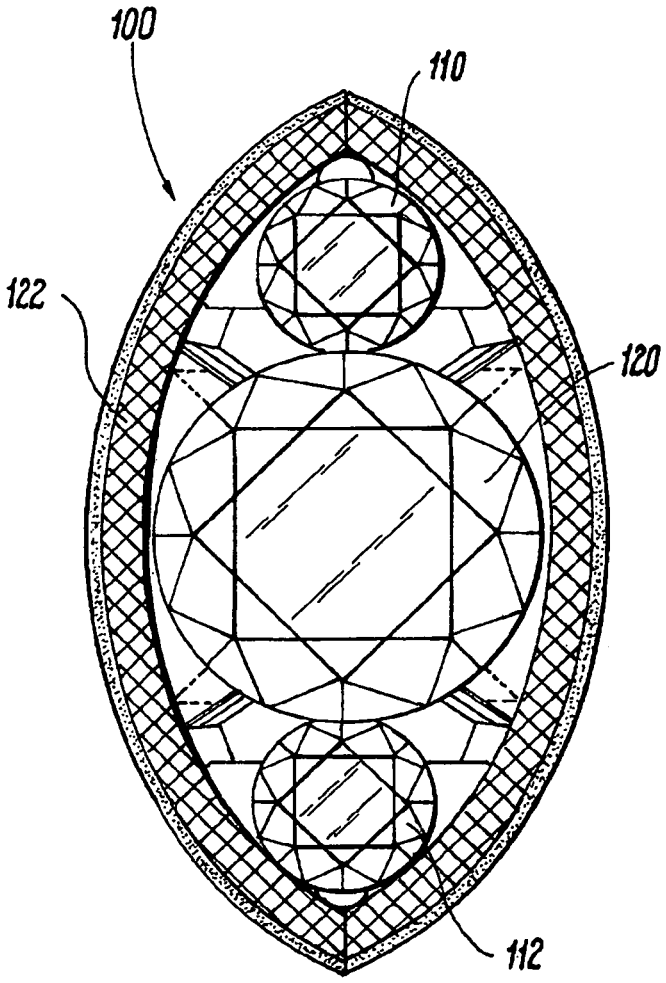
FIG. 8 illustrates a top view of a marquise shaped model with stones according to an exemplary embodiment of the present disclosure.
Figure 9:
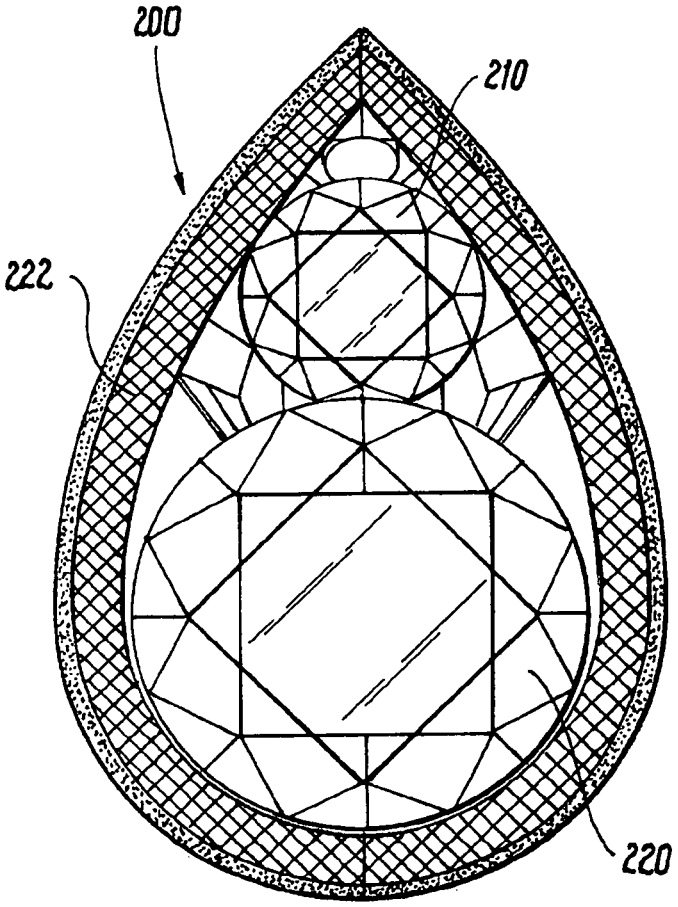
FIG. 9 illustrates a top view of a pear shaped model with stones according to an exemplary embodiment of the present disclosure.

As shown in FIG. 8, for the marquise shaped model 100, an outer upper portion of the marquise shaped model 100 is hammered down to form a bezel 122, securing the large stone 120 and small stones 110 and 112, creating a marquise shape. Similarly, as shown in FIG. 9, for the pear shaped model 200, an outer upper portion of the pear shaped model 200 is hammered down to form a bezel 222, securing the large stone 220 and small stone 210, creating a pear shape.

Figure 10:
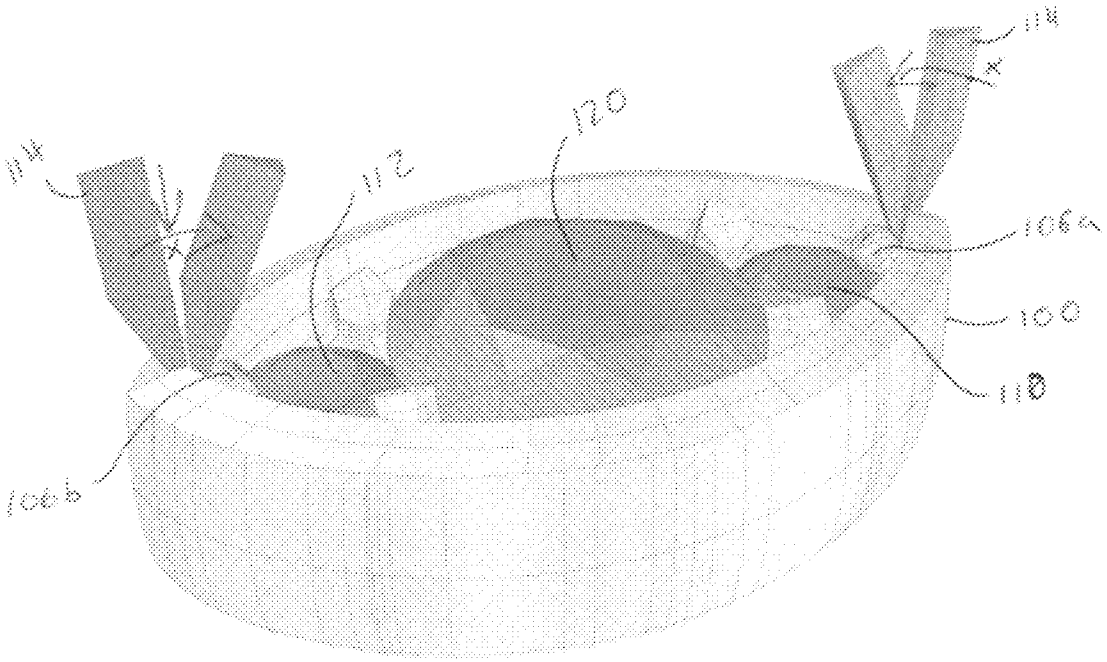
FIG. 10 illustrates a perspective view of a marquise shaped model with stones according to an exemplary embodiment of the present disclosure.
Figure 11:
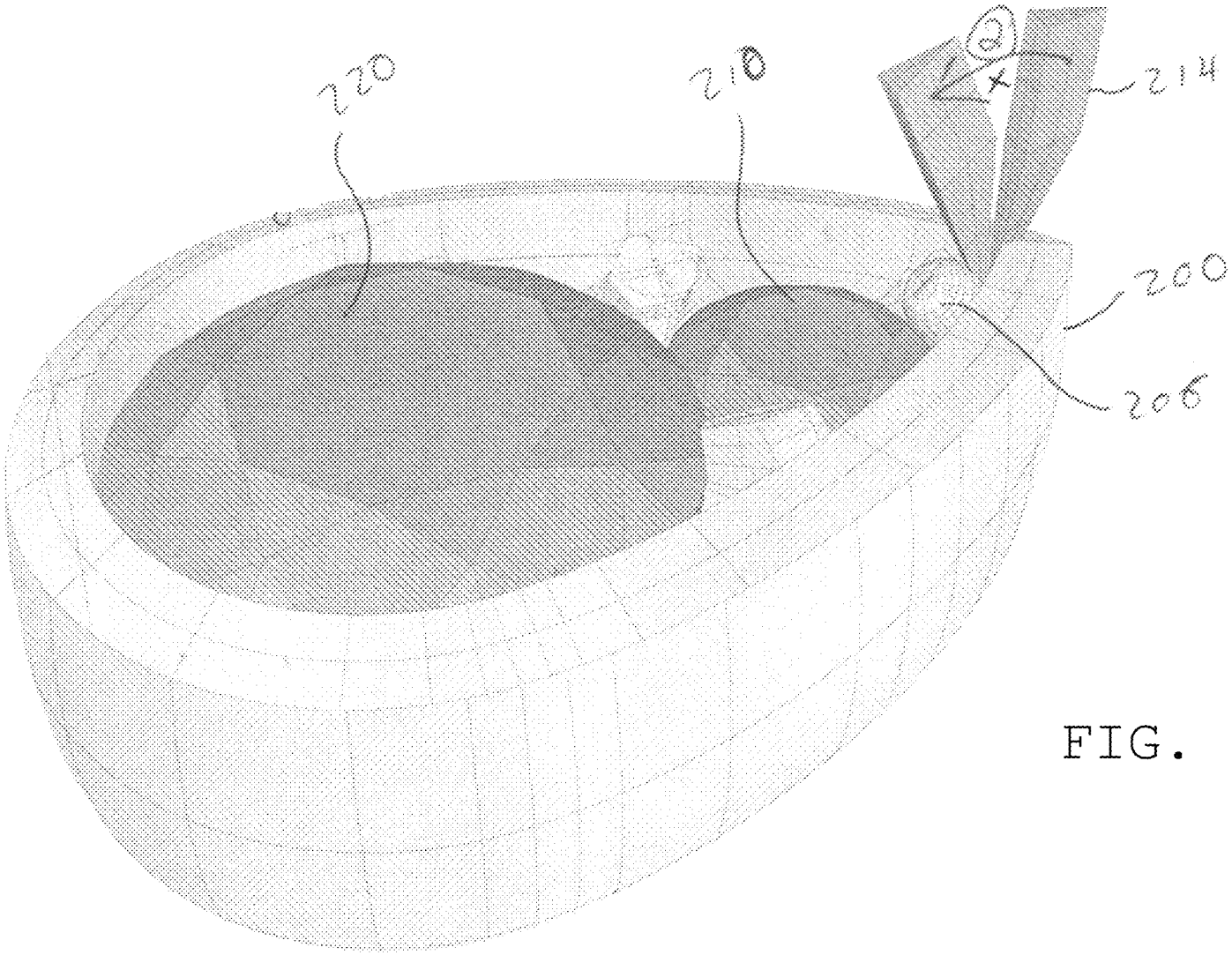
FIG. 11 illustrates a perspective view of a pear shaped model with stones according to an exemplary embodiment of the present disclosure.

As shown in FIG. 10, for the marquise shaped model 100, a graver 114 is used to push downward into the marquise shaped model 100, and then rotated in the direction X to move the end prongs 106*a* and 106*b* over the small stones 110 and 112, respectively, and also move the small stones 110 and 112 closer to the pavilion of the large stone 120. In some exemplary embodiments, the girdle of the small stones 110 and 112 is placed just slightly underneath the girdle of the large stone 120. As shown in FIG. 11, for the pear shaped model 200, a graver 214 is used to push downward into the marquise shaped model 100, and then rotated in the direction X to move the end prong 206 over the small stone 210, and also move the small stone 210 closer to the pavilion of the large stone 220. In some exemplary embodiments, the girdle of the small stone 210 is placed just slightly underneath the girdle of the large stone 220.

Figure 12:
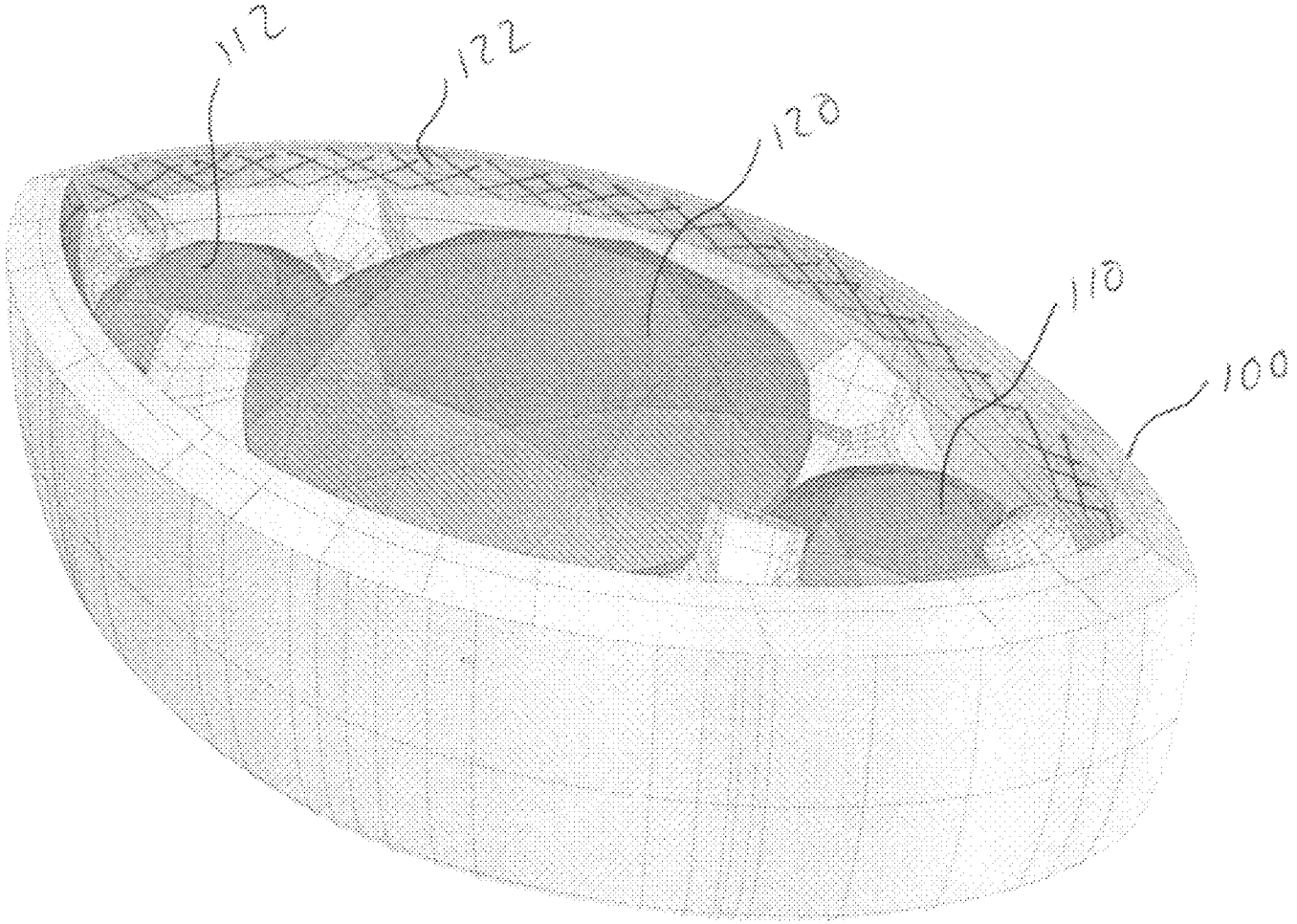
FIG. 12 illustrates a perspective view of a marquise shaped model with stones according to an exemplary embodiment of the present disclosure.
Figure 13:
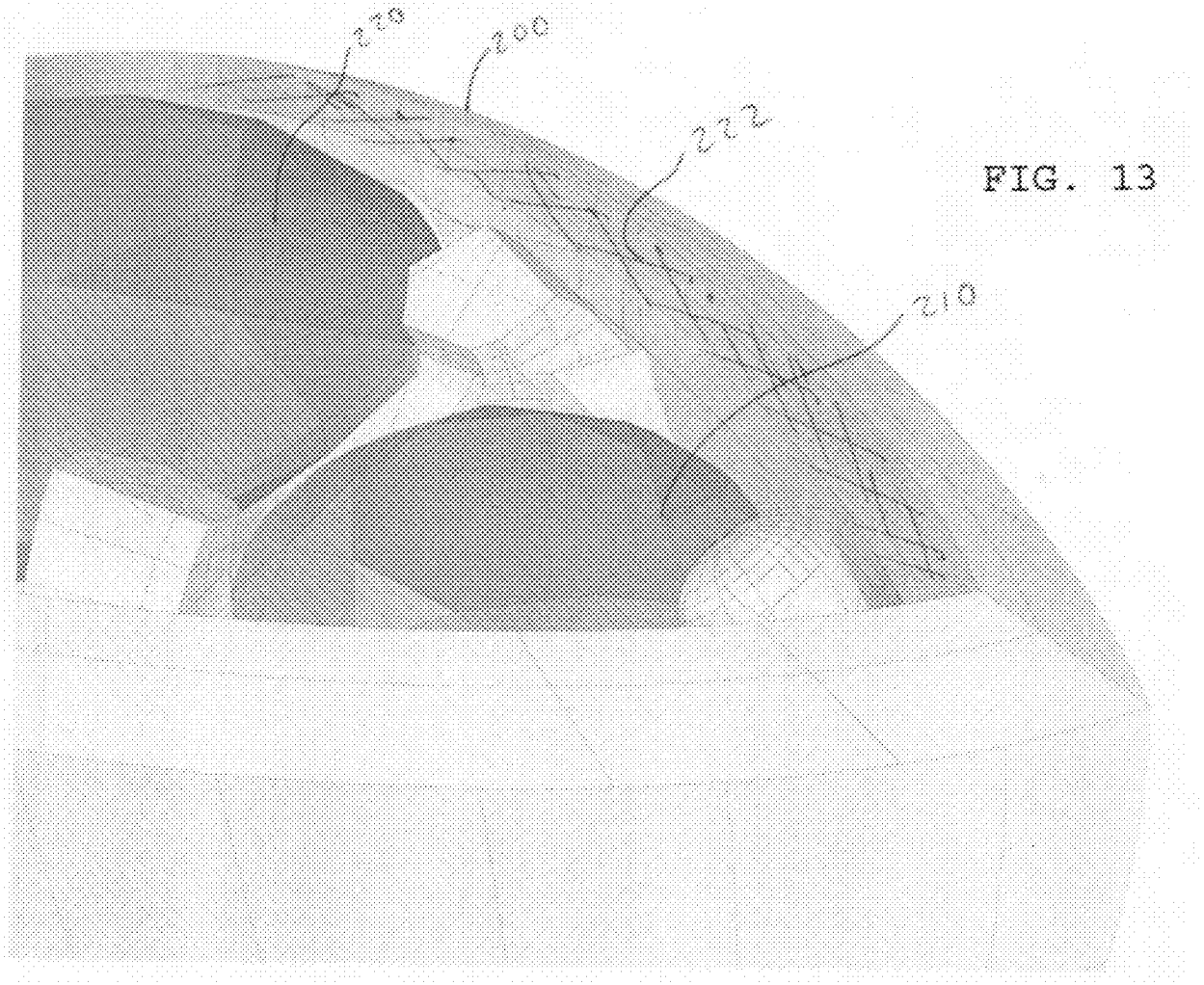
FIG. 13 illustrates a perspective view of a pear shaped model with stones according to an exemplary embodiment of the present disclosure.
Figure 14A:
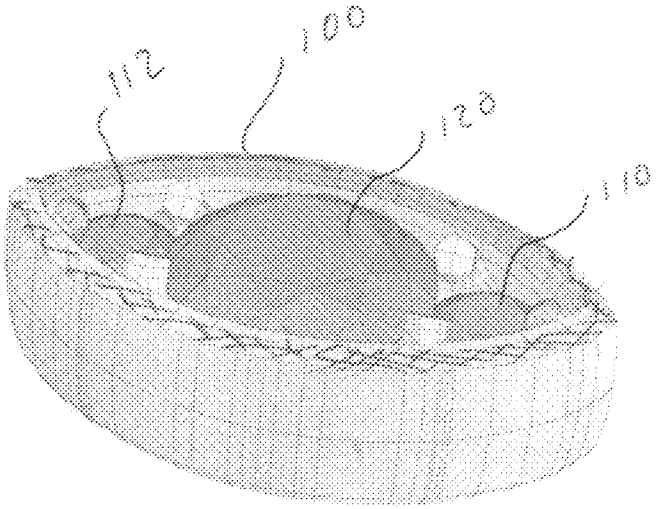
FIG. 14(*a*) illustrates a perspective view of a marquise shaped model with stones according to an exemplary embodiment of the present disclosure.
Figure 14B:
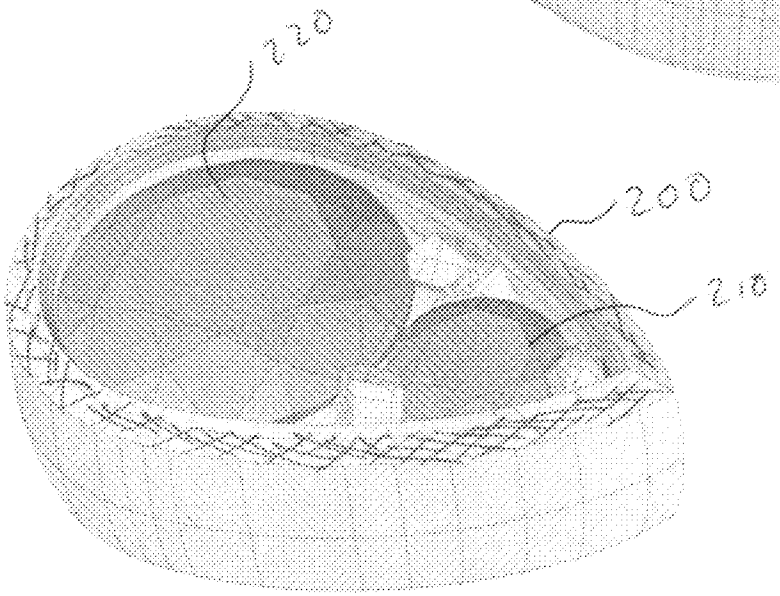

As shown in FIG. 12, for the marquise shaped model 100, and in FIG. 13 for the pear shaped model 200, using a pointed to flat graver, a brightcut is effected around the perimeter of the bezel 122 and 222, respectively. This can create a reflective or mirrored surface of the bezel that can be substantially free of irregularities. As shown in FIGS. 14(*a*) and 14(*b*), for the marquise shaped model 100 and pear shaped model 200, respectively, a rubber abrasive wheel, file or sanding disc, or a combination of these, can be used to smooth the bezel areas in preparation for final finishing, thus creating a smooth planar outline for the finished setting(s). In some exemplary embodiments, a beading tool of appropriate size can be used to round out the inner and end prongs and form spherical tips on the prongs. In some exemplary embodiments, the top of the stones can be cut down as needed.

Figure 15:
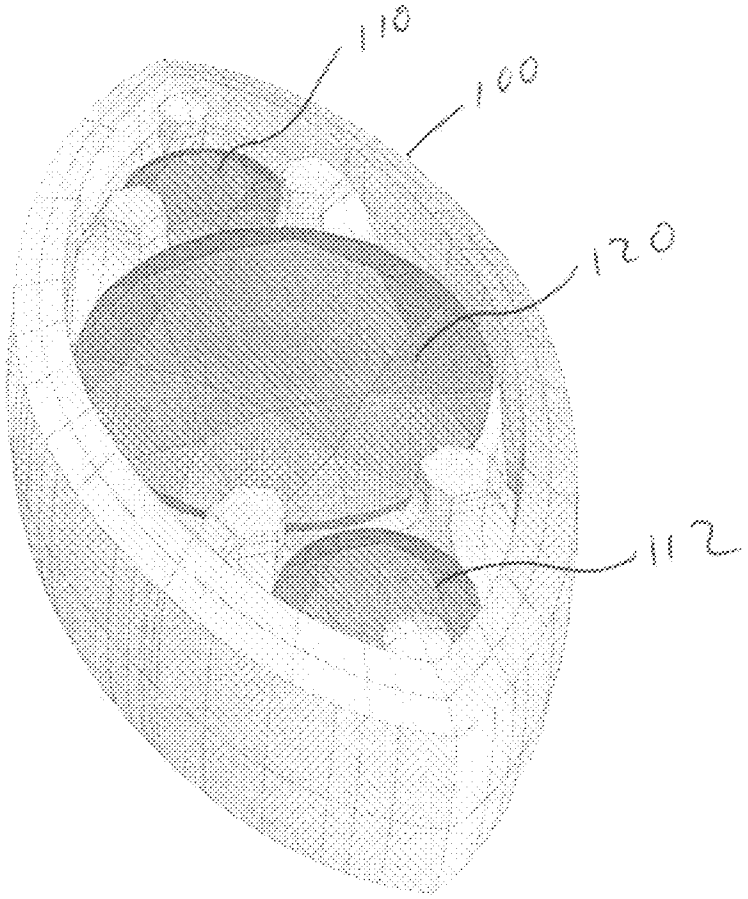
FIG. 15 illustrates a perspective view of a marquise shaped model with stones according to an exemplary embodiment of the present disclosure.
Figure 16:
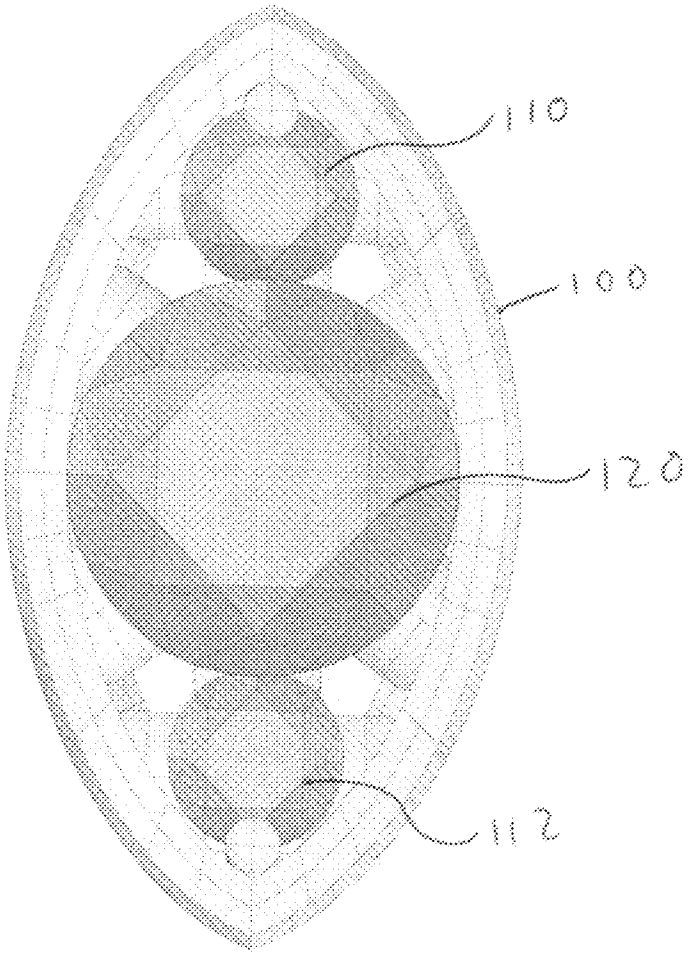
FIG. 16 illustrates a top view of a marquise shaped model with stones according to an exemplary embodiment of the present disclosure.
Figure 17:
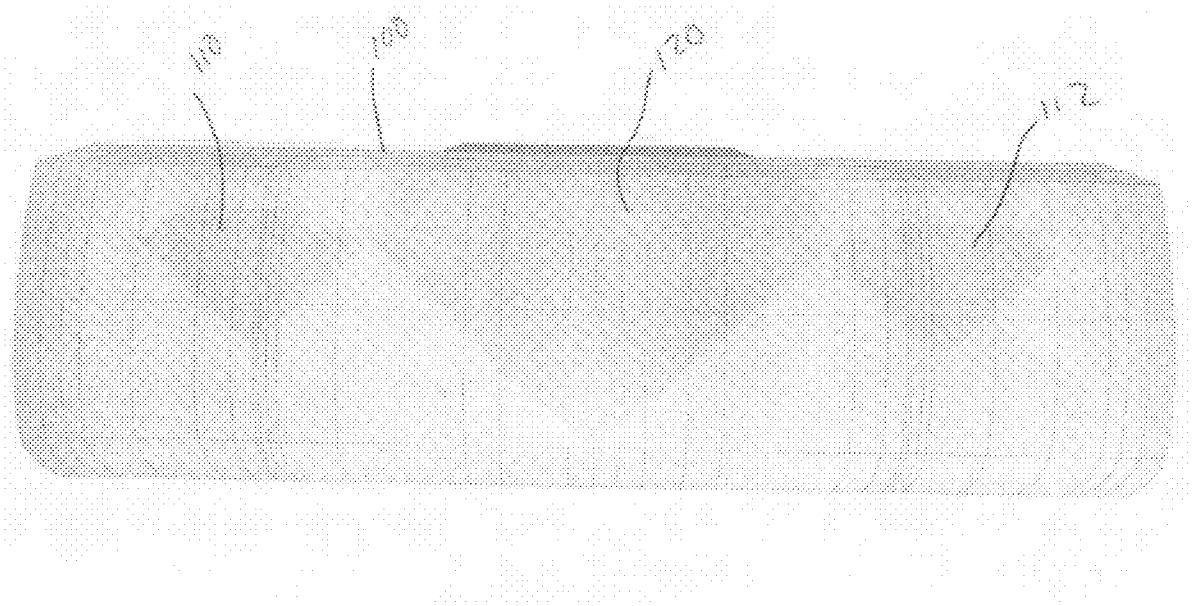
FIG. 17 illustrates a side view of a marquise shaped model with stones according to an exemplary embodiment of the present disclosure.
Figure 18:
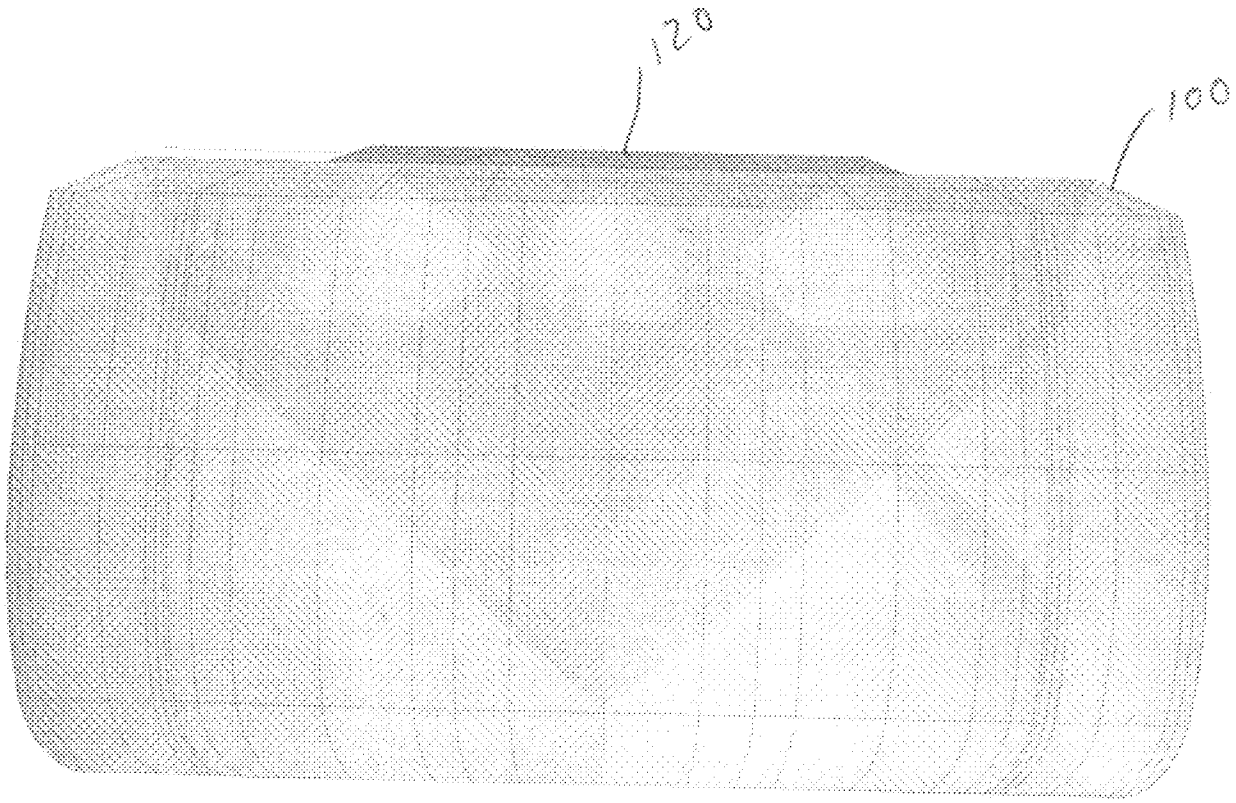
FIG. 18 illustrates a end view of a marquise shaped model with stones according to an exemplary embodiment of the present disclosure.
Figure 19:
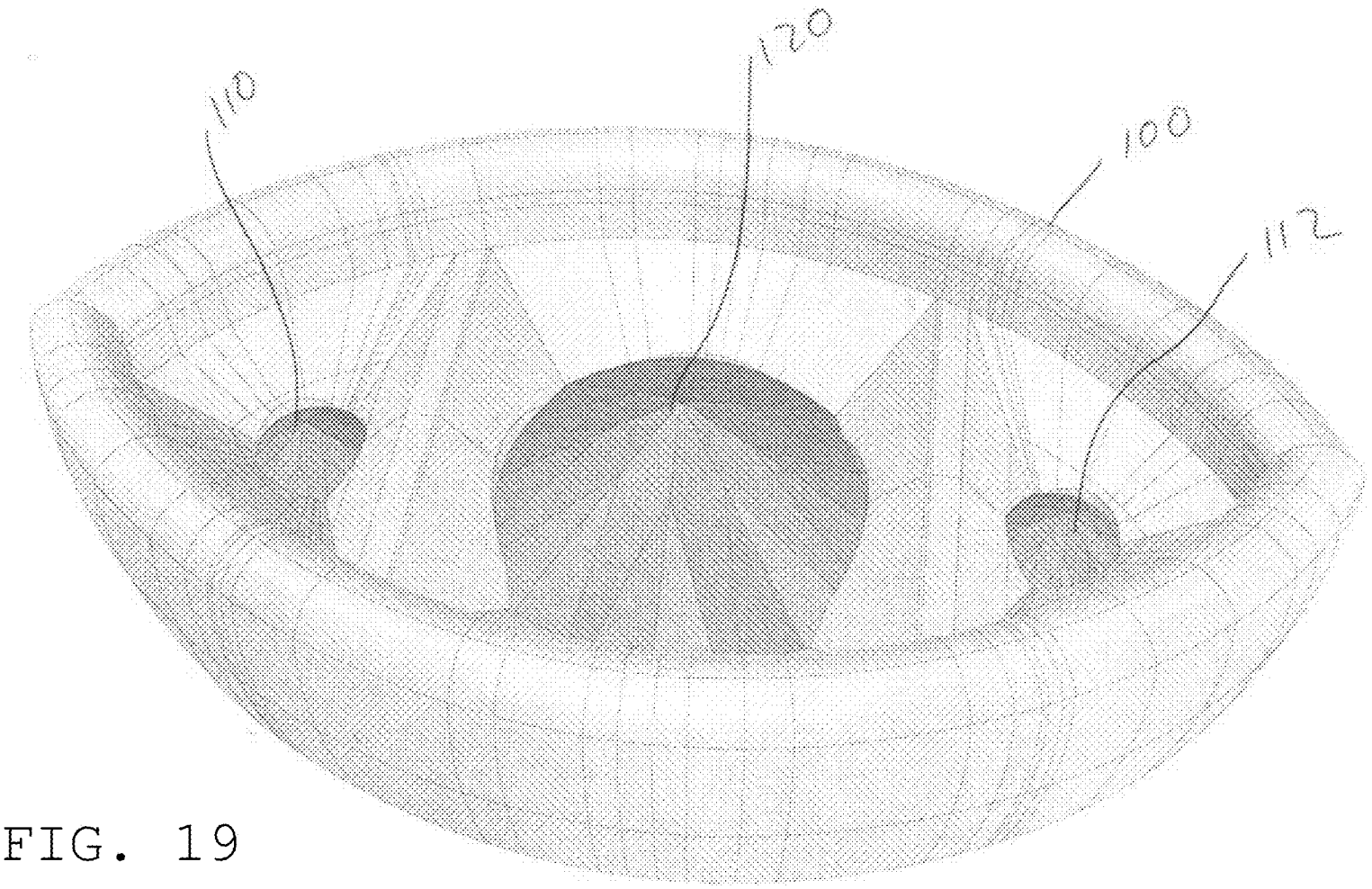
FIG. 19 illustrates a bottom perspective view of a marquise shaped model with stones according to an exemplary embodiment of the present disclosure.

FIG. 15 illustrates heights of the small and large stones when viewing the marquise shaped model 100. As can be seen, the height of the girdle of the large stone 120 is higher than the height of the girdle of the small stones 110 and 112. FIG. 16 illustrates the stone locations from a top view of the marquise shaped model 100. As can be seen, the large stone 120 slightly overlaps the small stones 110 and 112 on an upper and lower portion. FIGS. 17-19 illustrate a side view, end view and underside view, respectively, of the marquise shaped model 100, that further show the heights and layouts of the small stones 110 and 112 and the large stone 120 as set out in the marquise shaped model 100.

Figure 20:
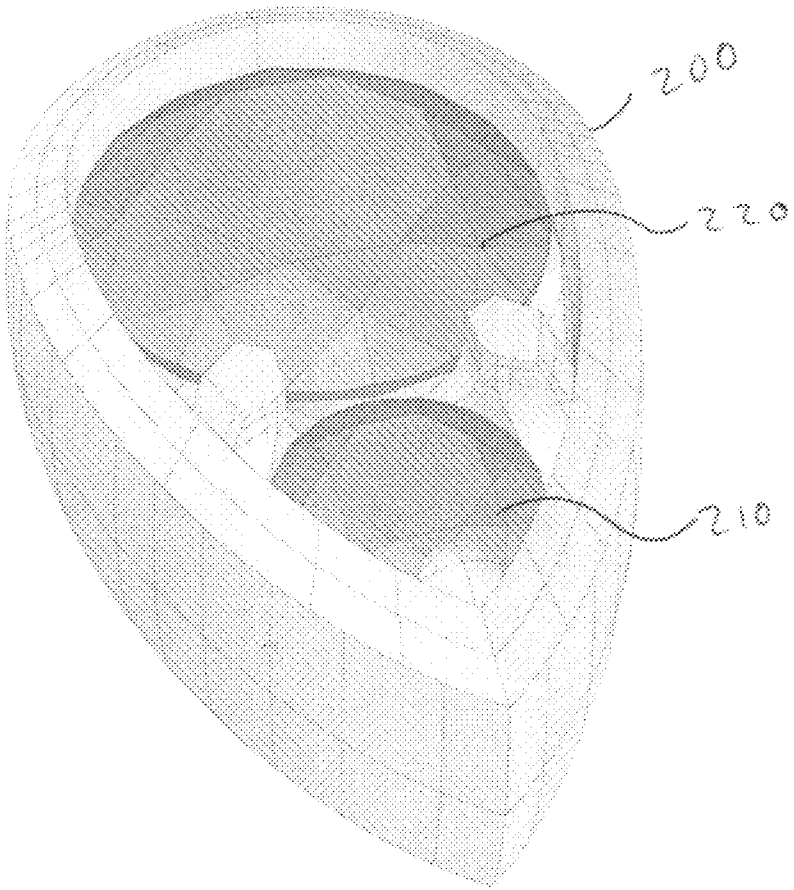
FIG. 20 illustrates a perspective view of a pear shaped model with stones according to an exemplary embodiment of the present disclosure.
Figure 21:
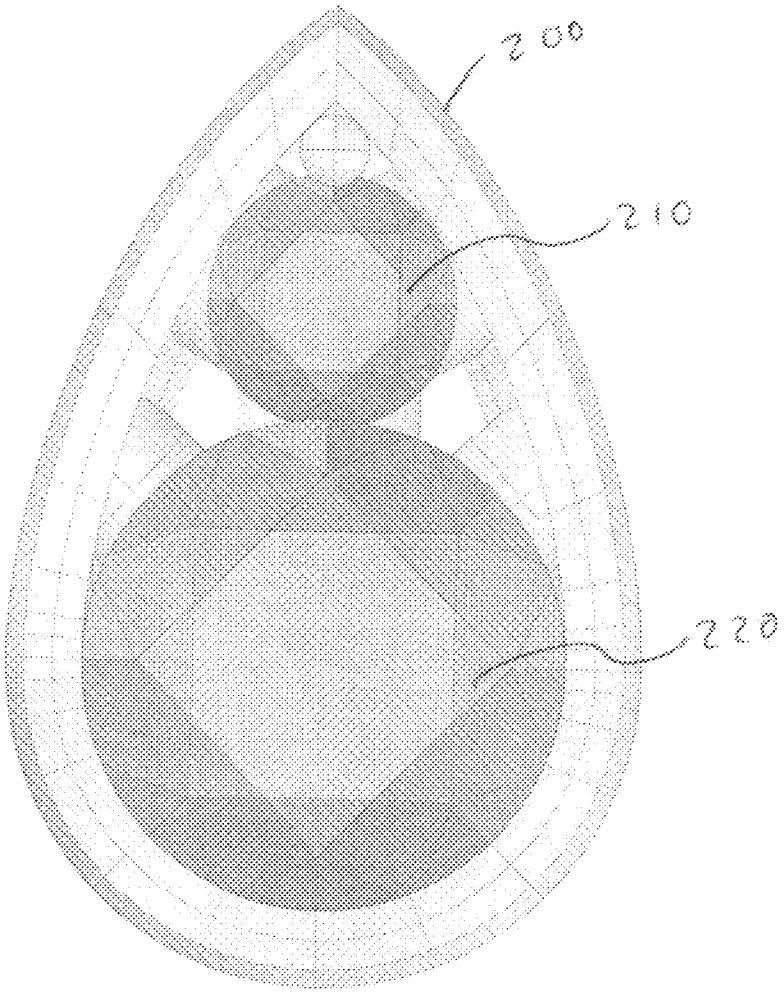
FIG. 21 illustrates a top view of a pear shaped model with stones according to an exemplary embodiment of the present disclosure.
Figure 22:
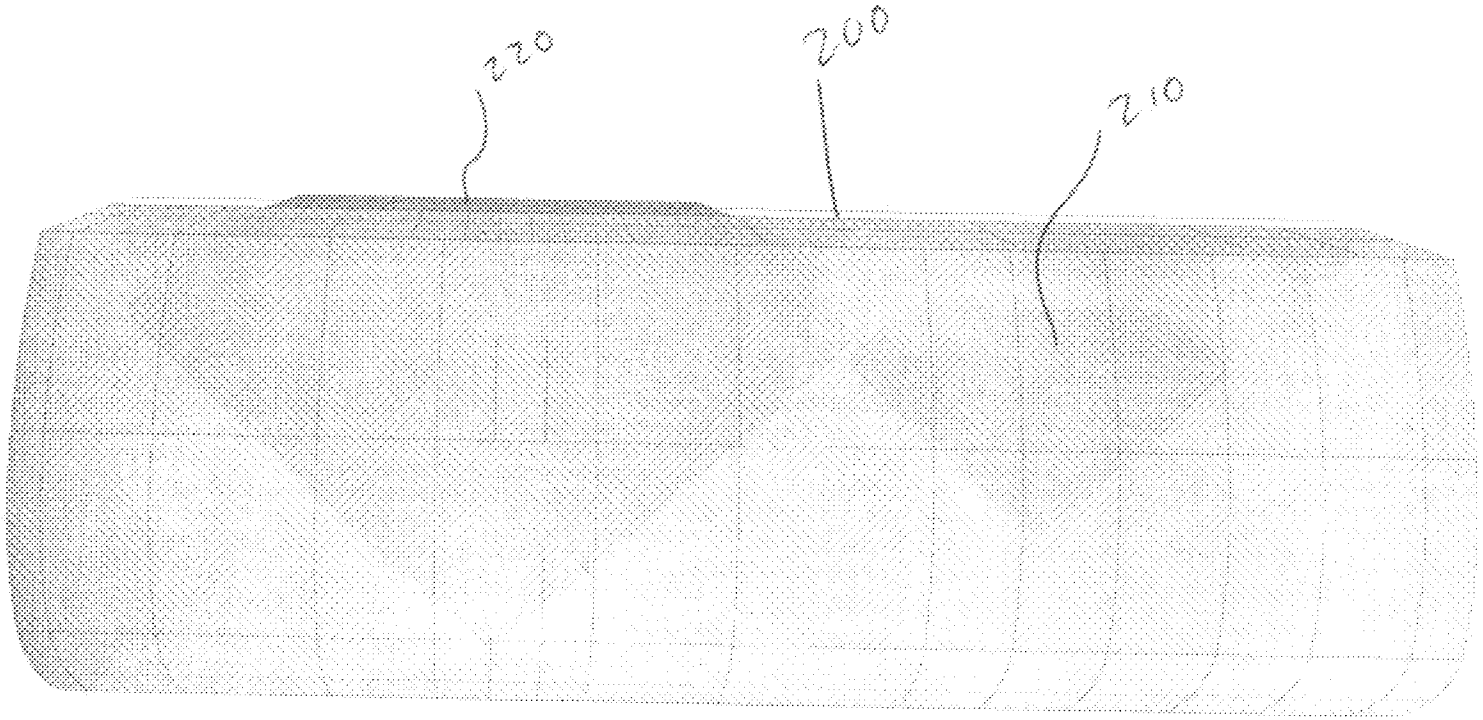
FIG. 22 illustrates a side view of a pear shaped model with stones according to an exemplary embodiment of the present disclosure.
Figure 23:
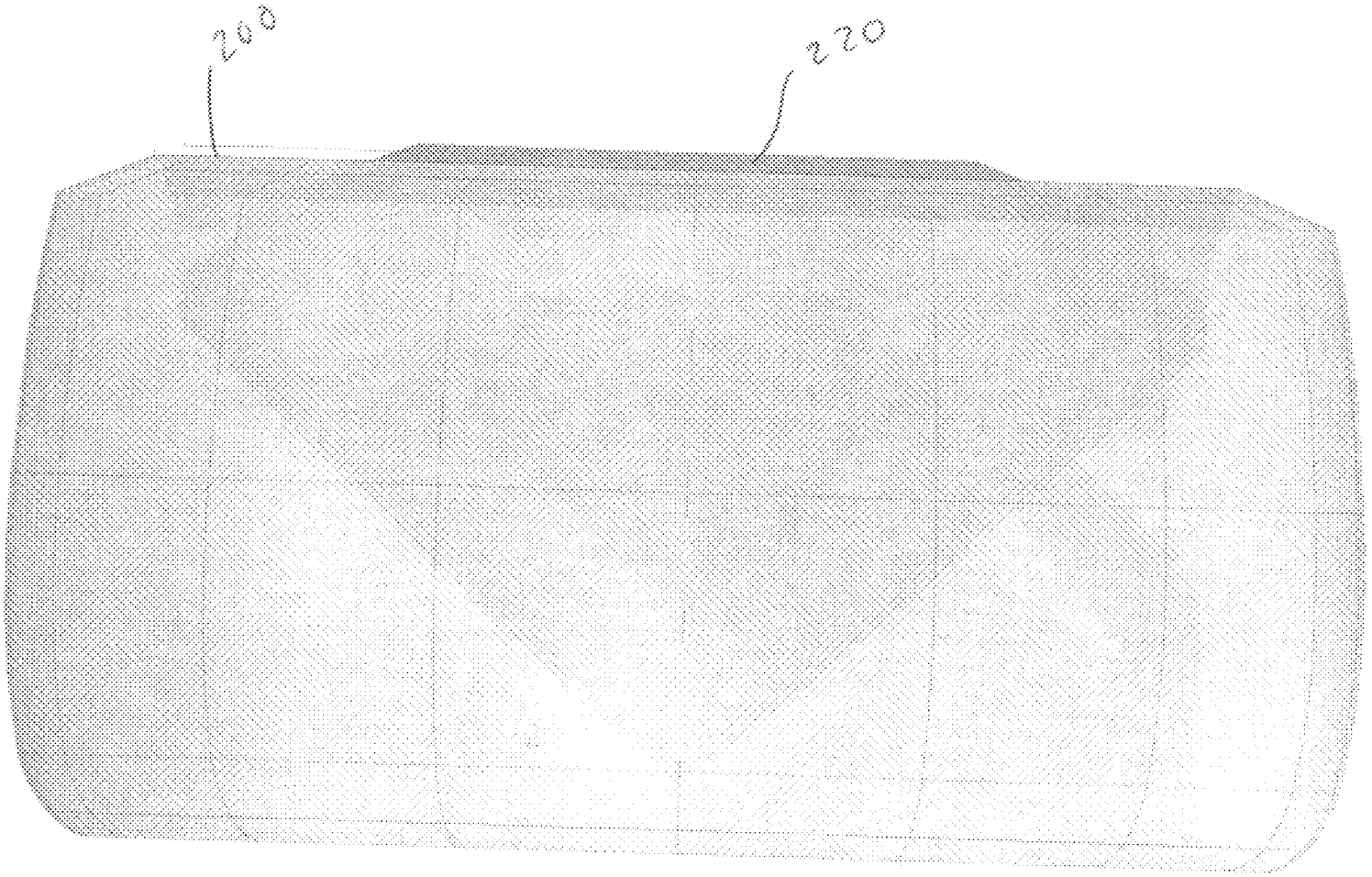
FIG. 23 illustrates a end view of a pear shaped model with stones according to an exemplary embodiment of the present disclosure.
Figure 24:
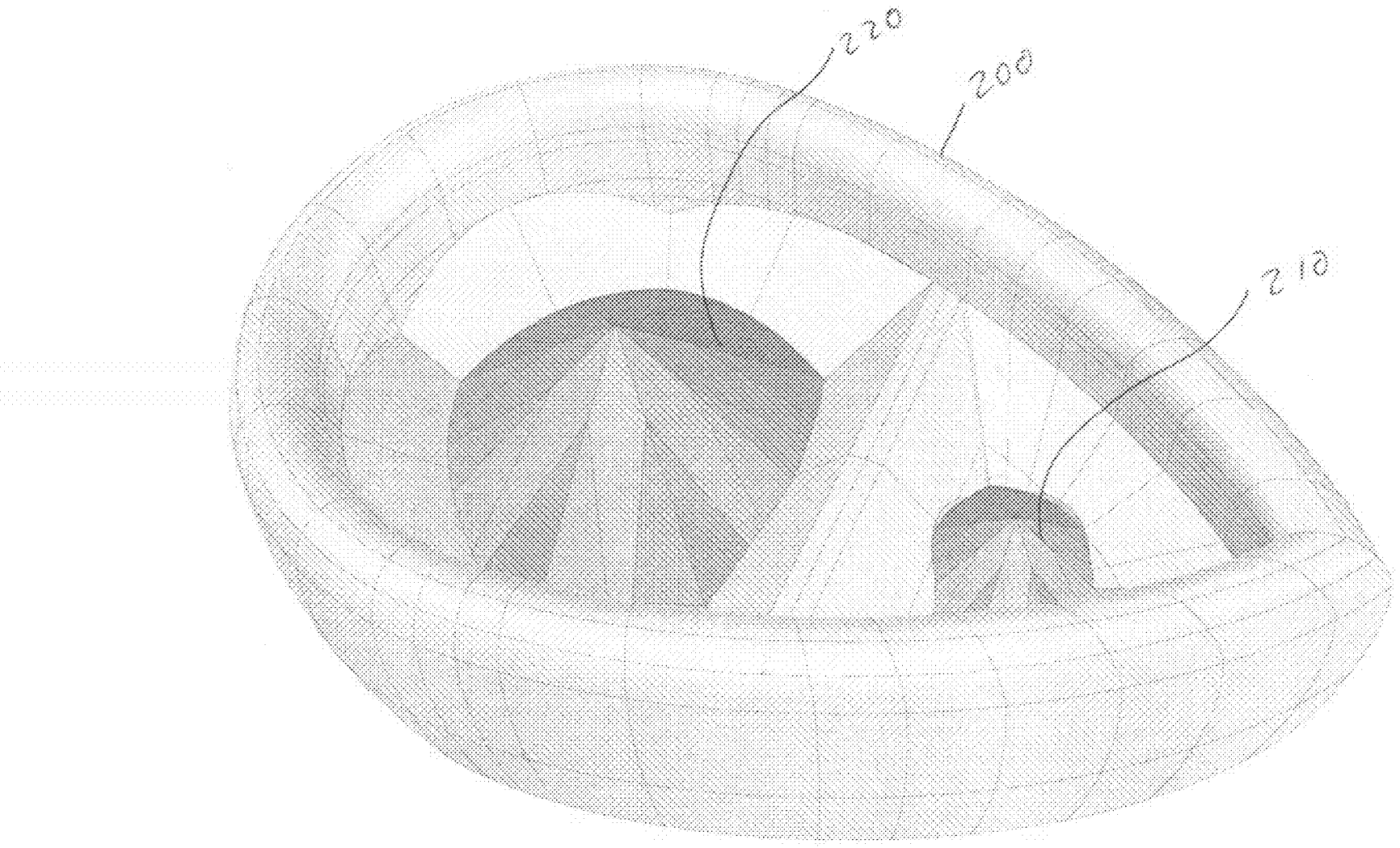
FIG. 24 illustrates a bottom perspective view of a pear shaped model with stones according to an exemplary embodiment of the present disclosure.

FIG. 20 illustrates heights of the small and large stones when viewing the pear shaped model 200. As can be seen, the height of the girdle of the large stone 220 is higher than the height of the girdle of the small stone 210. FIG. 21 illustrates the stone locations from a top view of the pear shaped model 200. As can be seen, the large stone 220 slightly overlaps the small stone 210. FIGS. 22-24 illustrate a side view, end view and underside view, respectively, of the pear shaped model 200, that further show the heights and layouts of the small stone 210 and the large stone 220 as set out in the pear shaped model 200.

Various advantages can be provided based on the exemplary embodiments described above. For example, models having various shapes and patterns can be provided in addition to pear or marquise shaped models, such as but not limited to oval, circular, elliptical, diamond or any polygonal shape. The models can be made of various materials, such as but not limited to metals, ceramic, glass, plastics or other materials. In some exemplary embodiments, the models can be made of a gold, platinum, silver, titanium, zirconium, steel or brass material. The small and large stones can be made of any gem, stone or jewel, such as but not limited to diamonds, rubies or sapphires, and can have various cuts, shapes and patterns.

In some exemplary embodiments, the small and large stones can have a circular or round top surface or table, which can have visual advantages, such as the multiple facets on a surface of a stone such as a diamond. Because of the lesser cost and availability of round diamonds or other round stones, and the added brilliance of round diamonds or other round stones, along with the lower weight by visual volume created by the setting process, a product or model can be created that is visually superior to more expensive diamond cuts (e.g., pear shape and marquise) for much less price per carat weight.

In some exemplary embodiments, the combination of small and large stones can cover a majority of a top visual surface of the model, such as 50-95% of the visual top surface, and preferably 75-95% of the visual top surface. The combination of small and large stones, and the combination of the small stones being provided slightly under the large stones, can provide for maximum coverage of the visual surface of the model with the stones. As the stones can be set at different levels and overlapped, a visual density can be provided to the model that is difficult to be duplicate with a single stone item that is of a higher carat weight. Such combinations allow greater coverage of the visual surface at approximately one third less than the carat weight of a single stone that would cover a similar percentage of the visual surface of the model.

Various modifications can be provided to the exemplary embodiments described above. For example, any combination and number of small and large stones can be used within the model. Models can be used singly, in groups or as linkage elements to emulate high end jewelry items at a fraction of the normal carat weight, which can be enhanced by the superior optical qualities of round cut diamonds.

The foregoing merely illustrates the principles of the disclosure. Various modifications and alterations to the described embodiments will be apparent to those skilled in the art in view of the teachings herein. It will thus be appreciated that those skilled in the art will be able to devise numerous systems, arrangements, manufacture and methods which, although not explicitly shown or described herein, embody the principles of the disclosure and are thus within the spirit and scope of the disclosure.

What is claimed is:

1. An article comprising:

a model having an inner side wall extending around an inner circumference of the model, an upper portion and a lower portion;

an upper stone seating provided at the upper portion and a lower stone seating provided at the lower portion of the model;

a middle stone seating between the upper stone seating and lower stone seating; and a plurality of prongs between the upper stone seating and lower stone seating placed along the inner side wall around a periphery of the middle stone seating;

wherein each of the plurality of prongs have a lower portion and an upper portion, where the lower portion is thicker than the upper portion of the prongs, and where the lower portion of the prongs are attached to the inner side wall and the upper portion does not extend above the inner side wall.

2. The article of claim 1, wherein at least two of the plurality of prongs are upper prongs provided between the upper stone seating and the middle stone seating.

3. The article of claim 2, wherein at least two of the plurality of prongs are lower prongs provided between the lower stone seating and the middle stone seating.

4. The article of claim 3, wherein the lower portion of the upper prongs are configured to secure a stone in the upper stone seating, and the lower portion of the lower prongs are configured to secure a stone in the lower stone seating.

5. The article of claim 4, wherein the upper portion of the upper prongs and the upper portion of the lower prongs are configured to secure a stone in the middle stone seating.

6. The article of claim 1, further comprising:

a top prong placed between the inner wall and the upper stone seating for securing a stone in the upper stone seating; and a bottom prong placed between the inner wall and the lower stone seating for securing a stone in the lower stone seating.

7. The article of claim 1, further comprising:

a top stone placed in the upper stone seating;

a bottom stone placed in the lower stone seating; and a middle stone placed in the middle stone seating, the middle stone being larger than the top and bottom stones and when secured within the model, having a top surface with a greater height than a top surface of the top and bottom stones.

8. The article of claim 7, further comprising:

an outer upper portion above the inner wall and surrounding the upper stone seating, the lower stone seating and middle stone seating;

wherein the outer upper portion is configured to be hammered down to provide a bezel for securing the top stone, bottom stone and middle stone.

9. The article of claim 1, wherein the model is a marquise shaped model.

10. An article comprising:

a model having an inner side wall extending around an inner circumference of the model, an upper portion and a lower portion;

an upper stone seating provided at the upper portion of the model;

a lower stone seating provided at the lower portion of the model; and a first prong and a second prong between the upper stone seating and lower stone seating placed along the inner side wall;

wherein the first and second prongs have a lower portion and an upper portion, where the lower portion is thicker than the upper portion of the first and second prongs, and where the lower portion of the prongs are attached to the inner side wall and the upper portion does not extend above the inner side wall.

11. The article of claim 10, wherein the lower portion of the first and second prongs are configured to secure a stone in the upper stone seating.

12. The article of claim 11, wherein the upper portion of the first and second prongs are configured to secure a stone in the lower stone seating.

13. The article of claim 10, further comprising:

a third prong placed between the inner wall and the upper stone seating for securing a stone in the upper stone seating.

14. The article of claim 10, further comprising:

a top stone placed in the upper stone seating; and a bottom stone placed in the lower stone seating;

wherein the bottom stone is larger than the top stone and when secured within the model, having a top surface with a greater height than a top surface of the top stone.

15. The article of claim 14, further comprising:

an outer upper portion above the inner wall and surrounding the upper stone seating and the lower stone seating;

wherein the outer upper portion is configured to be hammered down to provide a bezel for securing the top stone and bottom stone.

16. The article of claim 10, wherein the model is a pear shaped model.

* * * * *